US005996539A

United States Patent [19]

Göbel et al.

[11] Patent Number: 5,996,539

[45] Date of Patent: Dec. 7, 1999

[54] METHOD FOR AFFECTING THE MIXTURE FORMATION IN CYLINDERS OF PISTON-TYPE INTERNAL COMBUSTION ENGINES BY VARYING THE VALVE STROKES

[75] Inventors: Thomas Göbel, Bocholtz; Thomas Esch, Aachen, both of Germany

[73] Assignee: FEV Motorentechnik GmbH & Co KG, Aachen, Germany

[21] Appl. No.: 09/126,726

[22] Filed: Jul. 31, 1998

[30] Foreign Application Priority Data

Jul. 31, 1997 [DE] Germany ..... 197 33 140

[51] Int. Cl.[6] ..... F01L 9/04

[52] U.S. Cl. ..... 123/90.11; 123/90.15; 123/90.65; 251/129.16; 251/129.18; 335/266

[58] Field of Search ..... 123/90.11, 90.15, 123/90.65, 90.67; 251/129.01, 129.02, 129.1, 129.16, 129.18; 335/266

[56] References Cited

U.S. PATENT DOCUMENTS

| | | | |
|---|---|---|---|
| 4,455,543 | 6/1984 | Pischinger et al. | 335/266 |
| 4,715,330 | 12/1987 | Buchl | 123/90.11 |
| 4,715,331 | 12/1987 | Kreuter | 123/90.11 |
| 4,719,882 | 1/1988 | Kreuter | 123/90.11 |
| 4,777,915 | 10/1988 | Bonvallet | 123/90.11 |
| 5,131,624 | 7/1992 | Kreuter et al. | 251/129.18 |
| 5,611,303 | 3/1997 | Izuo | 123/90.11 |
| 5,636,601 | 6/1997 | Moriya et al. | 123/90.11 |
| 5,647,311 | 7/1997 | Liang et al. | 123/90.11 |
| 5,669,341 | 9/1997 | Ushirono et al. | 123/90.11 |

FOREIGN PATENT DOCUMENTS

| | | |
|---|---|---|
| 3024109C2 | 1/1982 | Germany . |
| 196 10 468 | 2/1997 | Germany . |

*Primary Examiner*—Weilun Lo
*Attorney, Agent, or Firm*—Venable; Norman N. Kunitz

[57] ABSTRACT

A method for actuating an electromagnetic actuator for a cylinder (gas exchange) valve of a piston-type internal combustion engine, wherein the actuator has two spaced electromagnets and an armature which is operatively connected to the cylinder valve and which is guided movably, as a function of the current supplied to the electromagnet by a control unit, in the closing direction counter to the force of an opener spring and in the opening position counter to the force of a closing spring, and for the normal stroke of the gas exchange valve, the armature is kept via the springs at the same spacing from the two electromagnets when the electromagnets are without current. To shorten the valve stroke during operation, the prestressing of one of the two springs, preferably the opener spring, is variable via an adjusting device which is triggered or controlled via the engine control unit.

10 Claims, 3 Drawing Sheets

METHOD FOR AFFECTING THE MIXTURE FORMATION IN CYLINDERS OF PISTON-TYPE INTERNAL COMBUSTION ENGINES BY VARYING THE VALVE STROKES

REFERENCE TO RELATED APPLICATIONS

This application claims the priority of German Application Ser. No. DE 197 33 140.8, filed Jul. 31, 1997 which is incorporated herein by reference.

BACKGROUND OF THE INVENTION

Piston-type internal combustion engines which are operated with freely triggerable or controllable gas exchange or cylinder valves can be operated without a throttle valve, even in Otto-engine modes of operation. Load control in such methods is achieved by various opening and closing instants of the cylinder (gas exchange) valves. To intensify the motion of the inflowing quantity of air or fresh gas, it is appropriate to generate a pronounced flow field on the intake side when the piston-type internal combustion engine is operated with low rpm and in a low load range. In addition, there is the problem that at high rpm the minimal flight times attainable via the actuator are too long for operation at low loads, i.e., low engine moments. The idea arises of solving the problem by adapting the inlet cross section.

From German published Patent Disclosure DE-A 196 10 468, a method for load-dependent control of the cylinder valves of a piston-type internal combustion engine is now known, in which during partial load operation the opening stroke is shortened, at least for the gas inlet valve of a cylinder, thus uncovering a smaller flow cross section. By shortening the opening stroke for partial load operation as compared to the opening stroke for the normal operating mode, a correspondingly reduced flow cross section is obtained at the valve inlet, so that a correspondingly lesser quantity of air or fresh gas is also aspirated. However, the lesser flow cross section in the inlet region means a higher flow velocity of the entering gas, resulting in a better mixing in the cylinder, which leads to better mixture preparation. In the known method, the desired stroke shortening is accomplished by suitable triggering or controlling of the electromagnetic actuators that are provided for actuating the cylinder valves. This is done in such a way that with the gas inlet valve closed, immediately after the holding current at the closing magnet is turned off and the motion of the cylinder valve in the opening direction ensues, the closing magnet is re-supplied with current, so that the gas exchange valve is moved back into the closing position after only a short stroke. In this method, operation is possible either with a partial stroke only, or with a full stroke only.

From German Patent Disclosure DE-A 30 24 109, corresponding to U.S. Pat. No. 4,555,543, issued Jun. 19, 1994, it is known to relax the opener spring, via a switching magnet, so much that the armature, in the closing position of the cylinder valve, contacts the pole face of the closing magnet even when the closing magnet is rendered currentless. This is intended to enable starting the electromagnetic actuators with less expenditure of energy, because when the engine is started current is first supplied to the closing magnet of a cylinder valve; then the opener spring is prestressed, and correspondingly, for the onset of motion when the closing magnet is made currentless, the full spring force of the opener spring is available for accelerating the armature and thus the cylinder valve. With this system, though, it is not possible to vary the stroke length of the cylinder valve.

OBJECT AND SUMMARY OF THE INVENTION

It is the object of the invention to provide a method that with electromagnetically actuated gas exchange valves, allows not only selective operation with a partial stroke or a full stroke, but also enables the transition from partial stroke to full stroke after the initiation of valve motion.

The above object generally is achieved according to the present invention in that in a method for actuating an electromagnetic actuator for a cylinder valve of a piston-type internal combustion engine that has two spaced-apart electromagnets, which are cyclically supplied with current as a function of a combustion cycle that is predetermined by an engine control unit and between which electromagnets an armature, which is operatively connected to the cylinder valve, is guided movably, as a function of the current supplied, in the closing direction counter to the force of an opener spring and in the opening position counter to the force of a closing spring, and wherein the armature is kept via the springs at the same spacing from the electromagnets for the normal stroke of the cylinder valve, it is proposed that, to shorten the valve stroke during operation, the prestressing of one of the two springs, preferably the opener spring, is variable via an adjusting arrangements, which is controlled via the engine control unit.

In such a procedure, by a targeted reduction in the prestressing of the opener spring and correspondingly a variation in the prestressing of the closer spring as well, a displacement of the armature in the direction of the closing magnet is attained. The prestressing of the opener spring is reduced so far that when the electromagnets are without current, the armature assumes its position of equilibrium a short distance away from the pole face of the closing magnet, which position is dictated by the contrary forces of the opener spring and the closing spring. Thus, when the electromagnets are without current, the valve opening is also opened, as a function of the armature spacing from the pole face of the closing magnet, by a corresponding magnitude that however is reduced compared to the normal stroke. Because of the slight armature spacing. Once the closing magnet is rendered currentless, the armature and the cylinder valve connected to it are then moved in the opening position via the opener spring, whereupon the position of equilibrium is overshot only slightly, so that then, by briefly supplying current to the closing magnet, the armature is brought in calmed fashion to the new mid position. The valve remains currentless, in the "valve open" position. To close the valve, the armature is attracted again, with a closing current. Since the timing for supplying current to the closing magnet can now be controlled in fully variable fashion via the engine control unit, the possibility thus also exists of opening the cylinder valve, given suitable specifications by the engine control unit, for arbitrary lengths of time within the cycle times specified by the piston motion. The method additionally offers the advantage of making it possible to start the electromagnetic actuator with the least possible expenditure of energy, without supplying current to the closing magnet beforehand.

Since the prestressing of the springs, preferably the opener spring, can be influenced directly via the engine control unit, it is also possible during a valve stroke, that is, after the release of the armature from the closing magnet, and while still in the set partial stroke position of equilibrium, to increase the prestressing of the springs, preferably the prestressing of the opener spring, and to shift the position of equilibrium for the armature to the normal position between the two electromagnets, so that when current is supplied to the opener magnet, after a brief partial stroke position, with the onset of valve motion the full valve stroke is then effected. In this first phase of only slight stroke motion, the fuel-air mixture then flows at high flow velocity into the combustion chamber, via the reduced valve cross section. Mixture preparation and homogenization are positively reinforced thereby. Because during the same opening phase of the valve a switchover is made to the full valve stroke, which assures optimal filling of the combustion chamber with fresh mixture, it is possible to actuate the gas inlet valve in the partial stroke position at least twice for a single intake stroke, so that the required quantity of fresh gas can flow into the cylinder at high velocity in two batches.

While it is possible in principle to connect the closing spring to a suitable adjusting device, it is expedient, above all for the sake of easier accessibility, to effect the variation of the prestressing, via the adjusting device or arrangement, by displacement of the base point of the opener spring.

In an advantageous further feature of the invention, it is provided that the displacement of the adjusting device or arrangement into its "normal stroke" position is effected by a force action that can be initiated from outside. The adjusting device is expediently locked, at least in this position. This arrangement has the advantage that the partial stroke position is the basic position for the actuator and can be maintained without requiring additional energy, yet on the other hand the normal operating mode is achieved with a full valve stroke by introducing a force through the adjusting device. The adjusting device may be held in this normal stroke position by this force alone, which can be accomplished via electromagnetic adjusting devices, for instance. It is expedient, however, if the adjusting device is locked in the normal stroke position, so that via the locking, an exact setting of the spring equilibrium and hence an exact setting of the valve stroke is obtained. Multi-stage locking correspondingly makes it possible to set graduated partial strokes with different opening cross sections.

In a feature of the invention, the initiation of the force action on the adjusting arrangement can be brought to bear via a flowable pressure medium. A flowable pressure medium is available, for instance, via the pressure medium supply to the internal combustion engine, so that, via suitable switching valves, the supply of pressure medium can be turned on and off. The advantage of electromagnet action, but also of hydraulic or pneumatic action, on the adjusting device is that the associated switching elements can likewise be triggered or controlled via the engine control unit, so that depending on the specified combustion cycles, the force action on the adjusting device can be exerted variably during a valve stroke.

The force action can also be brought to bear mechanically on the adjusting arrangement, for instance via adjusting eccentric elements or the like. Then, however, it is no longer readily possible to trigger or control the valve drive fully variably in its switchover between partial stroke and full stroke.

In a variation of the prestressing by displacing the base point of the opener spring, it is possible in a further advantageous feature of the invention for the displacement of the adjusting arrangement out of the "normal stroke" position into the "partial stroke" position to be effected by the force action of the closing magnet. This has the advantage that no additional adjusting force is needed for the adjustment out of the "normal stroke" position into the "partial stroke" position.

DESCRIPTION OF THE PREFERRED EMBODIMENT

Figure 1:
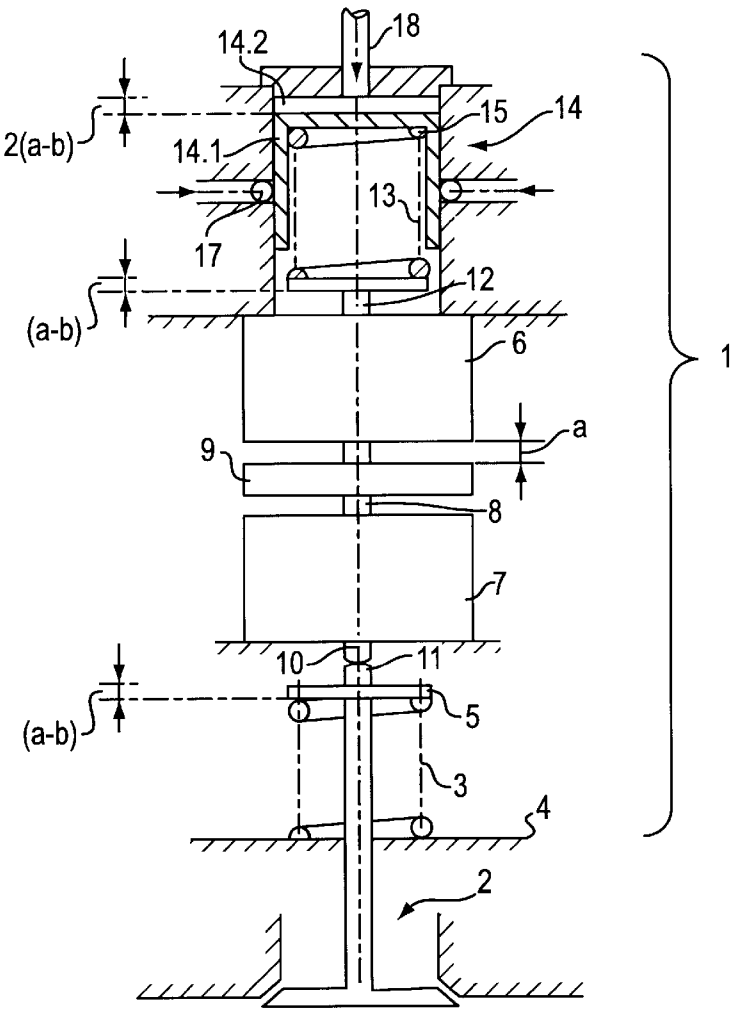
FIG. 1 shows an electromagnetic actuator with a gas exchange valve in the normal stroke position.

In FIG. 1, an electromagnetic actuator 1 for actuating a cylinder (gas exchange) valve 2 is shown schematically.

The cylinder (gas exchange) valve 2 is connected to a closing spring 3, which is braced or supported on the cylinder head 4 and which by its force action, via a valve plate 5, urges the cylinder valve in the closing direction.

The electromagnetic actuator 1 provided for actuating the cylinder valve 2 has two electromagnets 6 and 7. The electromagnet 6 acts as a closing magnet for the cylinder valve 2. Between the two electromagnets 6 and 7, which are spaced apart from one another, an armature 9 connected to a guide rod 8 is supported such that it can reciprocate. The guide rod 8 is braced or supported at one end 10 on the end 11 of the shaft of the cylinder valve 2, and is engaged at its other end 12 via an opener spring 13 which itself is engaged by an adjusting arrangement or device 14, for shifting or adjusting the base point or support 15 of the opener spring 13.

In normal operation, the arrangement is such that when the electromagnets 6, 7 are without current, the armature 9 is located in a mid position, specified by the design of the two springs 3 and 13, between the two electromagnets 6, 7, and in particular, a position which is spaced apart equally from each of the two electromagnets 6, 7. If current is supplied in alternation to the two electromagnets 6, 7, the armature 9, and thus the cylinder valve 2, can accordingly move back and forth between a closed position and an open position.

In the closed position, the armature 9 is held against the pole face of the closing magnet 6, which then is receiving current. If the closing magnet 6 is made currentless for the sake of opening the cylinder valve 2, then the force action of the valve 2 in the direction of the opener magnet 7, in the process overshooting the middle position shown in FIG. 1. If in this phase current is supplied to the opener magnet 7, then the armature 9 is "caught" by the developing magnetic field of the opener magnet 7 and made to contact the pole face thereof and is held against the opener magnet for as long as current is supplied to the opener magnet 7. For closing the cylinder valve 2, the process of movement described above is executed in reverse order. The timing of the current supply is predetermined by the engine control unit, which is not shown in detail here. The total stroke of the cylinder valve is predetermined by twice the spacing a between the armature 9 and the currentless electromagnet 6 or electromagnet 7.

Figure 2:
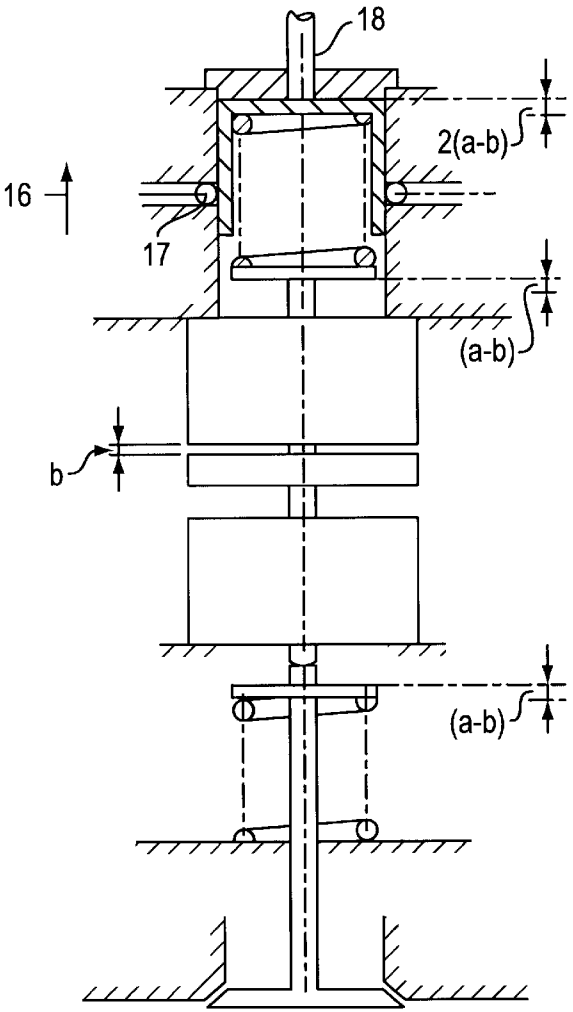
FIG. 2 shows the electromagnetic actuator with the gas exchange valve in the partial stroke position.

Now, if the base point 15 of the closing spring 13 is shifted in the direction of the arrow 16 via the adjusting arrangement 14 as shown in FIG. 2, then with the electromagnets 6, 7 rendered currentless, the position of equilibrium for the armature shifts in the direction of the closing magnet 6. The magnitude of the shift in the base point 15 is set such that in the position of equilibrium, the armature assumes an only slight spacing b from the pole face of the closing magnet 6. The spacing b is dimensioned to suit the intended partial stroke.

For operation in the partial stroke mode, it now suffices if, via the engine control unit, only the closing magnet 6 is supplied with current and rendered currentless in accordance with the predetermined combustion cycle, so that the armature 9 moves back and forth practically only by the magnitude b, and correspondingly the cylinder valve 2 is opened only by this slight magnitude. The opener magnet 7 is kept currentless in this operating mode.

Figure 3:
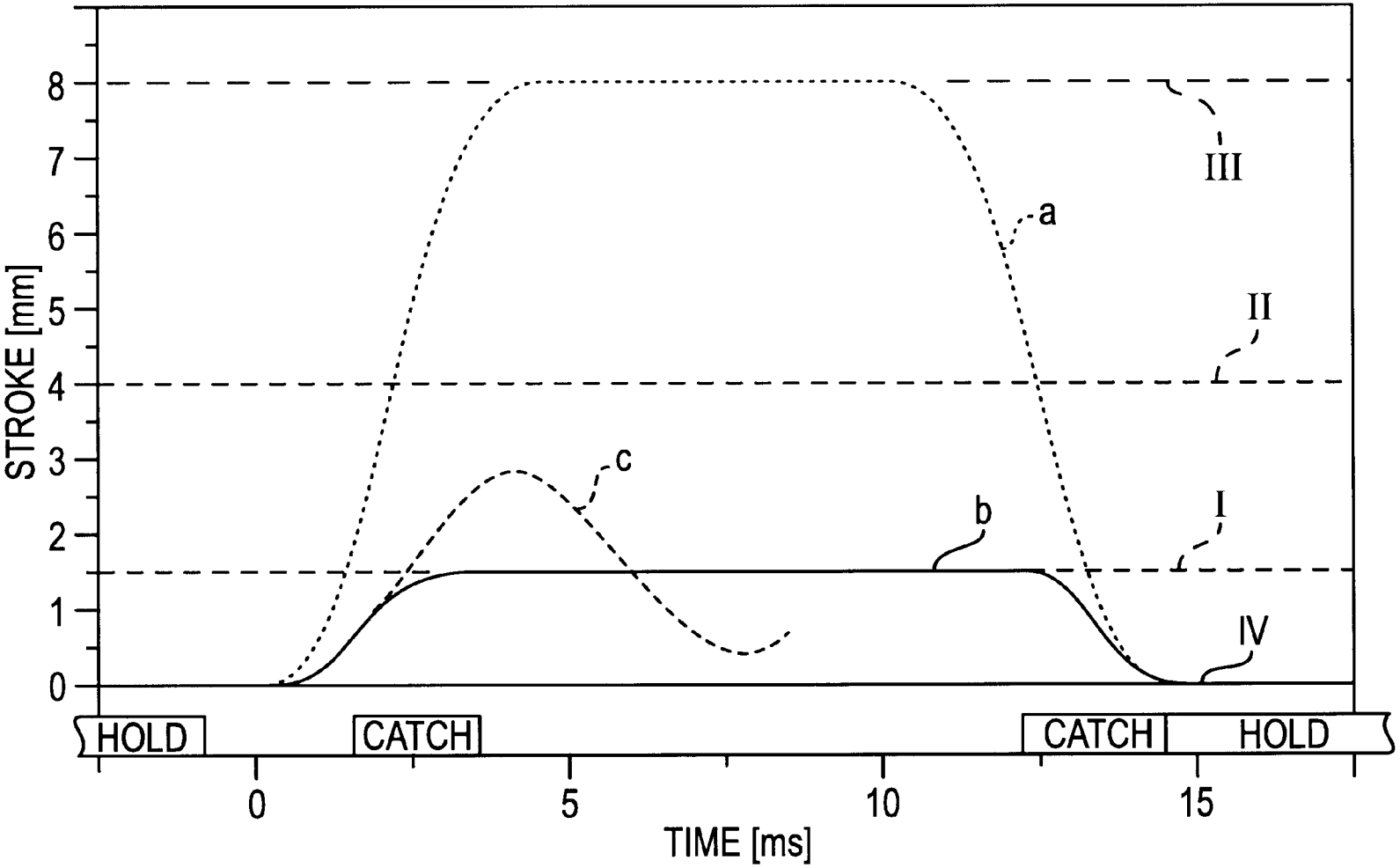
FIG. 3 shows the course of the stroke of the gas exchange valve as a function of time, in the partial stroke position and the normal stroke position.

In FIG. 3, with curve a, the normal stroke of the cylinder valve 2, as described in conjunction with FIG. 1, is shown over one combustion cycle.

FIG. 3 also, with curve b, shows the possible partial stroke of the cylinder valve 2 that is possible in the positioning of FIG. 2, again over one full combustion cycle.

In comparison to these curves, FIG. 3 with curve c shows the stroke course of the cylinder valve 2 that is possible via a purely electromagnetic method. To that end, for an armature position as shown in FIG. 1, immediately after the release of the armature 9 from the closing magnet 6, current is supplied to this magnet again, so that already after a short time in motion, the closing magnet 6 captures the armature again and keeps it in the closing position. It can be seem from a comparison of curves b and c that with the procedure described above, it is possible to assure defined opening cross sections even in the partial stroke mode, and it is entirely possible in the partial stroke mode to open and close the valve at least twice during one combustion cycle by suitably supplying current to the closing magnet 6.

The adjusting device 14 can now be acted upon by a "static" force action, which keeps the base point 15 of the closing spring 13 in one stroke position or the other for more than one combustion cycle, the force action on the adjusting device 14 again being controlled via the engine control unit.

Figure 4:
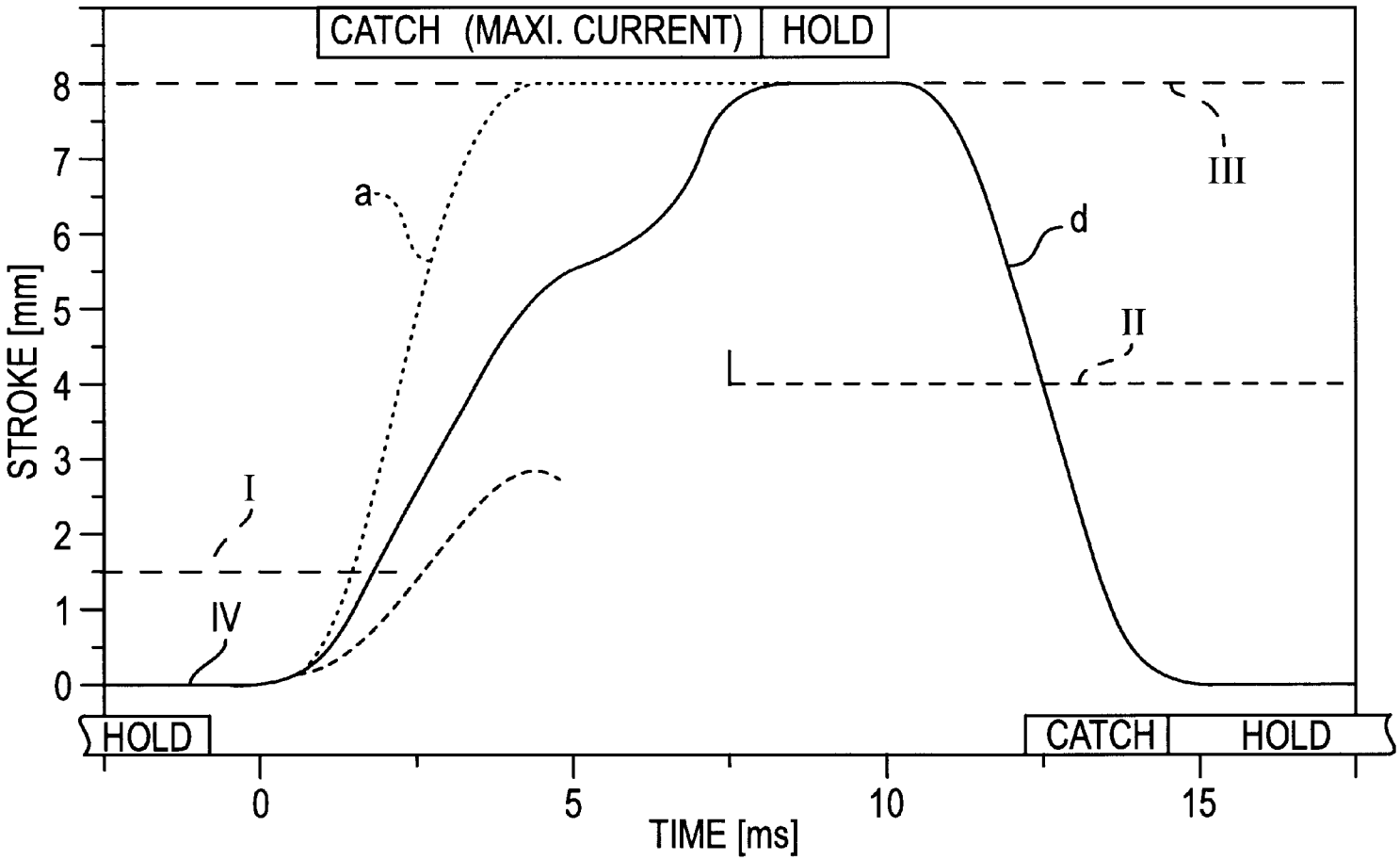
FIG. 4 shows the course of the stroke of the gas exchange valve with combined "partial stroke/normal stroke" triggering.

It is also possible now to act on the adjusting device 14 with a "dynamic" force action via the engine control unit, so that after an onset of opening from the partial stroke position shown in FIG. 2, the base point 15 is shifted even during the stroke in the direction of the normal stroke, and the opener magnet 7 is also supplied with current accordingly, so that by the end of the combustion cycle, for the applicable cylinder, the cylinder valve is fully open. This process is represented by the curve d in FIG. 4. If at the onset of the opening motion, the adjusting device 14 is still kept in its position of equilibrium shown in FIG. 2, which is represented by the line I in FIG. 4, and if immediately after the onset of the opening stroke the adjusting device 14 is acted upon by force action, then finally the full valve opening is attained, which is defined by the position shown in FIG. 1 for the adjusting device 14 with the corresponding position of equilibrium in the middle position, as represented by the line II in FIG. 4. Once the opener magnet 7 is made currentless and current is correspondingly supplied to the closing magnet 6, the armature 9 swings back into its closing position and comes to rest on the closing magnet 6, which is represented by the line IV in FIG. 4.

If this "partial stroke/normal stroke" mode is then to be continued over a plurality of operating cycles of the applicable cylinder, then immediately after the closure of the cylinder valve 2, the adjusting device 14 is returned from the position shown in FIG. 1 back to the position shown in FIG. 2, so that in the next combustion cycle the same course of motion can be accomplished.

Correspondingly, to initiate the closing process, when the opener magnet 7 is made currentless the adjusting device 14 is reset, resulting in a correspondingly modified closing curved.

In the exemplary embodiment shown in FIG. 1, the adjusting device 14 is embodied as a hydraulic or pneumatic element. The opener spring 13 is braced or supported here on a piston 14.1, which is guided in a cylinder 14.2 and can be acted upon (hydraulically or pneumatically) via a pressure medium introduced via the conduit 18, and accordingly either the position of the piston 14.1, and hence of the base point 15, as shown in either FIG. 1 or in FIG. 2 can be established.

In the exemplary embodiment shown here, with hydraulic or pneumatic pressure imposition, a lock for the piston 14.1 is provided, which may for instance be embodied as one or more pistonlike locking device 17, shown here as balls, and which can also be acted upon by the pressure medium and engage corresponding recesses in the wall of the piston 14.1.

If in the position shown in FIG. 2, the piston 14.1 is acted upon by the pressure medium introduces via conduit 18, then the piston 14.1 moves into the position shown in FIG. 1. The locking bodies 17 then automatically engage and lock the piston. If this system is made pressureless, then the opener spring 13, reinforced by the closing spring 3, can push the piston 14.1 back into its outset position shown in FIG. 2, so that an additional controlled introduction of force from outside is not needed.

The system described above can also be modified by providing that the pressure impingement for the piston 14.1 on the one hand and the locking means 17 on the other hand are controlled independently. Consequently, the piston 14.1, in an arrangement with a corresponding additional detent, could also be retained in an intermediate position between the two operating positions shown here.

It will be readily appreciated that the force action on the adjusting device or arrangement 14 is actuatable not only hydraulically or pneumatically but that a mechanical or electromagnetic force action may also be provided here.

The invention now fully being described, it will be apparent to one of ordinary skill in the art that many changes and modifications can be made thereto without departing form the spirit or scope of the invention as set forth herein.

What is claimed:

1. A method for actuating an electromagnetic actuator for a cylinder valve of a piston-type internal combustion engine which actuator has two spaced-apart electromagnets which are cyclically supplied with current as a function of a combustion cycle that can be predetermined by an engine control unit and between which an armature, which is operatively connected to the cylinder valve, is guided movably, as a function of the current supplied, in the closing direction counter to the force of an opener spring and in the opening position counter to the force of a closing spring, and wherein for a normal stroke of the cylinder valve, the armature is position via the springs at a neutral position with the same spacing from the two electromagnets when the electromagnets are without current, said method comprising the steps of cyclically supplying current to the electromagnets of the actuator as a function of a combustion cycle, and under control of the engine control unit, to cause movement of the cylinder valve between an open and a closed position; and shortening the valve stroke to a partial stroke from the normal stroke, resulting in a shift of the neutral position of the armature substantially closer to one of the electromagnets, during operation by varying the prestressing of one of the opener spring and the closing spring under control of the engine control unit.

2. The method according to claim 1, wherein the prestressed one of the springs is the opener spring.

3. The method according to claim 2, wherein: the opener spring is provided with a controllable adjusting device for supporting a base of the opener spring; and the variation of the prestressing is effected by displacement, via the adjusting device, of a base position of the opener spring.

4. The method according to claim 3, further comprising displacing of the adjusting device into a position for the normal stroke of the cylinder valve by a force action Initiated from outside under control of the engine control unit.

5. The method according to claim 4, wherein the force action is brought to bear on the adjusting device via a flowable pressure medium.

6. The method according to claims 4, wherein the force action is brought to bear mechanically on the adjusting device.

7. The method according to claim 4, further comprising normally controllably locating the adjusting device in the position for the normal stroke of the cylinder valve.

8. The method according to claim 7, wherein the displacement of the adjusting means into a position for the partial stroke is effected by canceling out the force action an the adjusting device by the force action of the closing spring.

9. The method according to claim 2, wherein to actuate the cylinder valve in the partial stroke position, only the closing magnet is supplied with current via the engine control unit, and the opener magnet remains without current.

10. The method according to claim 3, further comprising the steps of: to vary the flow conditions for the gases flowing into the cylinder via the cylinder valve, initiating the onset of motion upon valve opening in the partial stroke position, and thereafter, during the further motion during a stroke cycle, displacing the adjusting device into the normal stroke position and then again returning the adjusting device to the partial stroke position.

* * * * *